United States Patent [19]

Von Holdt

[11] Patent Number: 4,512,493

[45] Date of Patent: Apr. 23, 1985

[54] MOLDED BUCKET AND LID HAVING HIGH STACK STRENGTH

[76] Inventor: John W. Von Holdt, 7340 N. Croname Rd., Niles, Ill. 60648

[21] Appl. No.: 519,253

[22] Filed: Aug. 1, 1983

Related U.S. Application Data

[63] Continuation-in-part of Ser. No. 356,496, Mar. 9, 1982, Pat. No. 4,420,093, which is a continuation-in-part of Ser. No. 319,933, Nov. 10, 1981, Pat. No. 4,452,382, and Ser. No. 329,258, Dec. 10, 1981, Pat. No. 4,380,305.

[51] Int. Cl.[3] ..... B65D 41/16; B65D 41/18

[52] U.S. Cl. ..... 220/306; 220/380; 220/270; 206/505; 206/508

[58] Field of Search ..... 220/306, 380, 270, 69, 220/70; 206/505, 508; 150/0.5

[56] References Cited

U.S. PATENT DOCUMENTS

| | | | |
|---|---|---|---|
| 3,237,803 | 3/1966 | Edwards | 220/380 |
| 4,111,329 | 9/1978 | Lampman | 220/266 |
| 4,165,020 | 8/1979 | Hoselton | 206/505 |
| 4,420,093 | 12/1983 | Von Holdt | 206/508 |
| 4,422,559 | 12/1983 | Landis | 220/380 |

FOREIGN PATENT DOCUMENTS

| | | | |
|---|---|---|---|
| 0052172 | 5/1982 | European Pat. Off | 220/306 |

*Primary Examiner*—George T. Hall
*Attorney, Agent, or Firm*—Charles F. Pigott, Jr.

[57] ABSTRACT

A molded bucket comprises a bucket lip defining an enlarged annular projection at the mouth of the bucket; an inwardly positioned annular shelf facing the mouth adjacent the lip; and an outwardly positioned annular flange joined to said bucket adjacent the annular shelf to provide extra hoop strength to the area of the shelf. The lid for the bucket defines an annular recess receiving the annular projection of the bucket lip in locking relation and an annular straight wall which extends radially inwardly from the recess, at an angle of essentially 10° to 60° from the axis of the bucket, with the inner edge extending outwardly toward the mouth relative to the outer edge. The angled annular straight wall serves as a cantilever beam to transmit stacking force to the annular shelf, so that the bucket does not distort or collapse under conditions of high stacking, the bucket being preferably a tapered bucket.

9 Claims, 11 Drawing Figures

MOLDED BUCKET AND LID HAVING HIGH STACK STRENGTH

CROSS-REFERENCE TO RELATED APPLICATIONS

This application is a continuation-in-part of my copending U.S. application Ser. No. 356,496, filed Mar. 9, 1982, now U.S. Pat. No. 4,420,093 which is, in turn, a continuation-in-part of U.S. application Ser. No. 319,933, filed Nov. 10, 1981, now U.S. Pat. No. 4,452,382 and U.S. application Ser. No. 329,258, filed Dec. 10, 1981, now U.S. Pat. No. 4,380,305.

BACKGROUND OF THE INVENTION

In U.S. Pat. No. 4,210,258, a seal for plastic buckets and cans is disclosed in which the lip of the bucket and the lid are of a design that permits easy opening, while at the same time avoiding accidental "pop-off" of the lid upon dropping of the bucket, despite the inherently greater flexibility of plastic over the conventional metal cans.

In accordance with this invention, a plastic bucket is provided which can exhibit good resistance to accidental "pop-off" of the lid, while being readily removable by the user, and also where the bucket exhibits exceptional stacking strength so that even though the bucket is made of plastic material, large, heavy, filled buckets of the design of this invention can be stacked twelve or thirteen high without distortion or collapse of the lowest bucket in the stack. In one embodiment, a tear strip is provided that insures retention of the lid until the user removes the strip. The tear strip is generally arranged to require a tool to remove it to deter opening of the bucket, except by the user.

DESCRIPTION OF THE INVENTION

In accordance with this invention, a molded bucket comprises a bucket lip defining an enlarged, annular projection at the mouth of the bucket, an inwardly positioned annular shelf facing the mouth adjacent the lip, and an outwardly positioned annular flange joined to the bucket adjacent the annular shelf, to provide extra hoop strength to the area of the annular shelf. The annular flange may particularly be curved in its cross section to define a flange section which is in longitudinal relation to the bucket wall, so that the flange will not project outwardly in an inconvenient manner.

The lid which may be attached to the bucket may define in one piece a peripheral, annular, recess, receiving the annular projection in locking relation. An annular straight wall extends radially inwardly from the vicinity of the recess at an angle of essentially 10° to 60° from the axis of the bucket, with the annular, straight wall being positioned with its outer edge adjacent the annular recess, and also positioned to abut the annular shelf so as to be supported by the shelf. The inner edge of the annular straight wall extends outwardly toward the mouth, relative to the outer edge.

As the result of this, the bucket and lid exhibit high stacking strength when the weight of another bucket carried on the lid is transmitted by the annular, straight wall to the annular shelf, being supported by the reinforced area, in terms of hoop strength, of the annular shelf. Particularly, tapered buckets are desirably used in conjunction with this invention so that the bottom of the bucket has less diameter than the lip, being particularly of a diameter of no more than the inner edge of the annular straight wall.

Empty buckets, in accordance with the invention, may be stacked in substantial numbers in absence of a lid. In one embodiment, an upward facing, internal shoulder engages the bottom of a stacked bucket in an improved manner for effective stacking. Radial vanes may also be provided to stiffen the annular straight wall, which may act as a sort of annular cantilever beam to transmit the force to the reinforced bucket mouth as described above.

A tear strip is provided to retain the lid until use. The strip cannot readily be removed without a tool until the lid is initially used. This prevents undesired opening of the lid or premature removal of the tear strip.

A number of strengthening ribs are arranged at the bottom of the bucket adjacent its foot, on the outward flange, and on the lid for improved strength of the structure in accordance with one embodiment of the invention. These ribs may constitute unique diagonal ribs or diagonal ribs with radial vanes, for added stiffness for some applications.

Also, an annular, upstanding flange may be provided on the outer side of the lid at the inner edge of the annular straight wall to receive the end of the tapered bucket therein for proper positioning of the bucket.

Such a structure has been shown to exhibit very high stacking strength, while having many other good characteristics for a bucket capable of reliably sealing its contents even when dropped, but at the same time being easily openable.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout, wherein.

DESCRIPTION OF THE PREFERRED EMBODIMENTS

Figure 1:
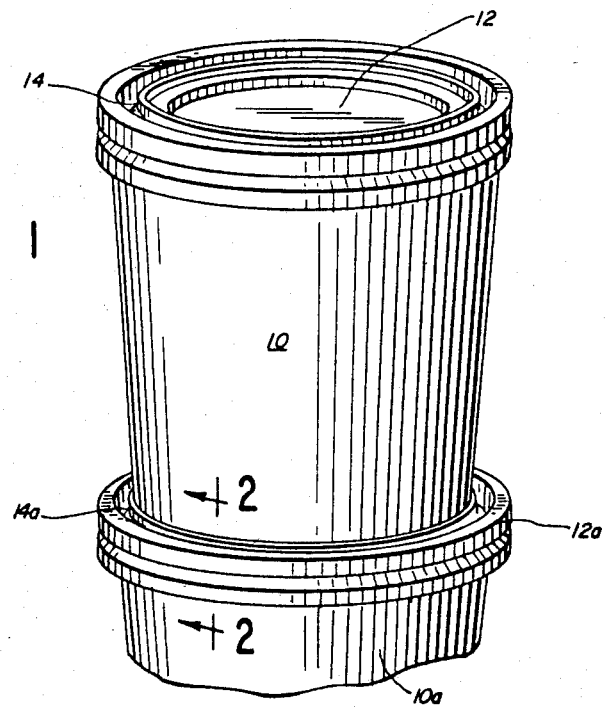
FIG. 1 is a perspective view of a first embodiment of a bucket in accordance with this invention, being shown as part of a stack of said buckets.
Figure 2:
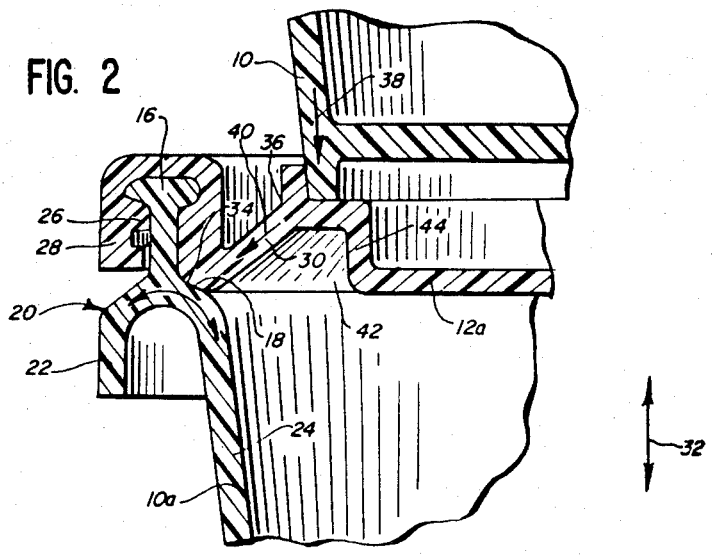
FIG. 2 is an enlarged secional view taken along lines 2—2 of FIG. 1.

Referring to FIGS. 1 and 2, the illustrated first embodiment of the invention wherein bucket 10 carries a lid 12, both being made out of a plastic such as polyethylene or a copolymer thereof, and being stacked on top of an identical bucket 10*a* which also carries a lid 12*a* which, in turn, carries the weight of the bucket 10. As shown, lids 12, 12*a* respectively include an outer ring 14, 14*a* on the upper surfaces thereof, which rings serve to center and position the bottom of a tapered bucket stacked above it, to assure that the weight of the upper bucket 10 can be transmitted to the annular shelf of the bucket underneath.

As shown in FIG. 2, bucket 10*a* (and also bucket 10) defines an enlarged annular projection 16 at the mouth thereof, and an inwardly positioned, annular shelf 18 facing the mouth of the bucket adjacent lip 16. Outwardly positioned annular flange 20 is joined to the bucket adjacent annular shelf 18. Annular flange 20 can be seen to be curved in cross section to define a flange section 22 which is in longitudinal relation to the wall 24 of bucket 10 or 10*a*.

Buckets 10, 10*a* and lids 12, 12*a* can be molded by conventional techniques out of polyolefin plastic or the like.

As shown in FIG. 2, lid 12*a*, which is identical in design to lid 12, is attached to lip 16 with the lid defining in one piece a peripheral, annular recess 26 which receives and holds lip 16 in locking relation. Outer flange 28 of lid 12*a* may be pried outwardly by a screwdriver or the like to release the locking relation of annular recess 26 and lip 16, with lids 12, 12*a* being sealable off of the annular lip 16 of the buckets 10, 10*a*. For closing the bucket, lip 16 can simply be snapped into recess 26 by appropriate pounding or other pressure. Alternatively, the lid may be affixed to the lip by an external tear strip (not shown) which may be initially torn by using a screwdriver and the like. The tear strip technique will be described in detail in the following description of the embodiment shown in FIGS. 3–10.

Lids 12, 12*a* also define annular straight wall 30 which extends radially inwardly from recess 26 in an angle of essentially 10° to 60° from axis 32 of the bucket, the annular, straight wall 30 being positioned with its outer edge 34 being adjacent annular recess 26, and being particularly positioned to abut against annular shelf 18 in force-transmitting relation. The inner edge 36 of annular straight wall extends outwardly toward the bucket mouth relative to outer edge 34, so that force from the weight of the upper stacked bucket 10, as shown by vector 38, can be transmitted as shown in vector 40 through annular staight wall to annular shelf 18.

As the result of this, the bucket and lid system of this invention exhibits improved stacking strength, and is able to withstand greater loads on lids 12, 12*a* than comparable plastic buckets of other known designs.

If desired, a series of radial ribs 42 may be provided to further strengthen annular straight wall 30, and prevent it from deflecting. These optional radial ribs may be connected as an integral part of the underside of annular wall 30 and communicate with inner annular wall 44 as an integral part of lids 12, 12*a*. While ribs 42 are optional, typically from three to twenty-four of such ribs may be used, depending upon the particular strength that may be desired. Ribs 42 may be an integral molded part of each lid 12, 12*a*.

The bucket of this invention exhibits the advantage that it appears to be a conventional bucket, and thus is a familiar looking item to the trade, despite the novel structure incorporate herein. For example, ribs 42 are invisible until the bucket is opened, and annular straight wall 30 is not particularly noticeable unless the bucket is carefully inspected.

Referring now to FIGS. 3–8, there is illustrated another embodiment of the improved bucket and lid system of the invention exhibiting improved stacking strength and capable of withstanding greater loads.

Figure 3:
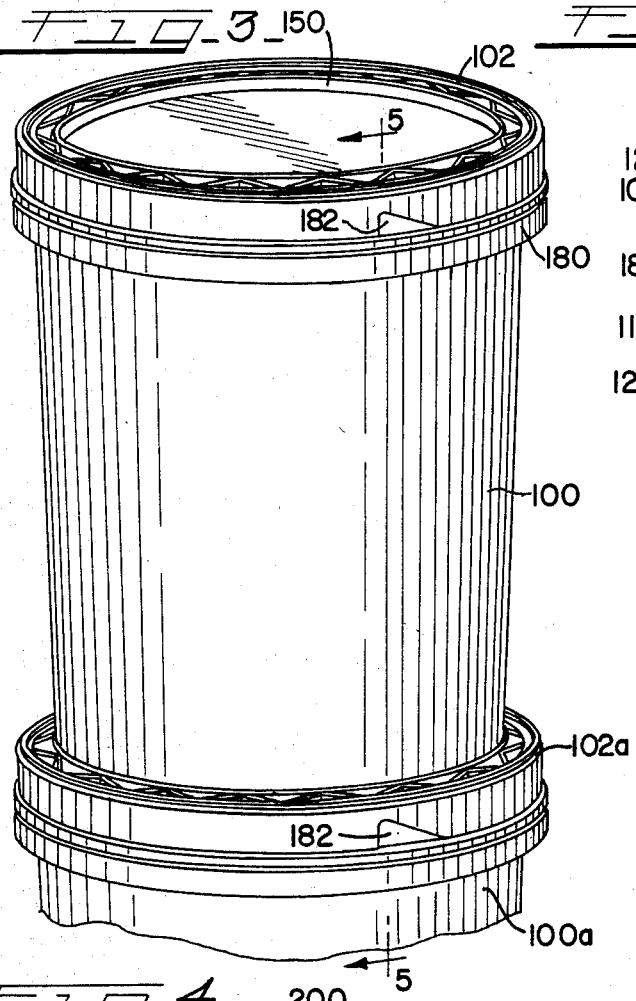
FIG. 3 is a front perspective view of another embodiment of the bucket in accordance with the present invention.

Referring now to FIG. 3, the second embodiment of this invention is directed to a bucket 100, which carries a lid 102, both made out of a plastic, such as a polyethylene or a copolymer thereof, and being stacked on top of an identical bucket 100*a* which also carries a lid 102*a*, which, in turn, carries the weight of the bucket 100. The bucket 100 includes several improved features which are best illustrated in connection with FIG. 5. The wall of the bucket 100 is molded, such as in the area of its upper mouth 104 and bottom, with a more uniform thickness to compensate for non-uniformity of curing that occurs in walls of variable thickness of prior art containers and result in undesired weakening stress points.

By using a unique arrangement of strengthening features, an improved bucket and lid of enhanced strength for high stacking and the like is attained. The mouth 104 of the bucket is formed by an integral projection 108 which extends upward from the sidewall 112 of the bucket 100 through a radially projecting transitional portion 114 that forms a flat annular ledge 116. The projection 108 includes an annular bottom sidewall 110 having a uniform thickness and terminating with a top edge having an enlarged top portion 118 and forming a pair of downward facing shoulders 120 which engage the lid in a manner to be described. Although the locking shoulders 120 may be disposed in any suitable plane, it is preferred that the shoulders 120 lie in upward, sloped planes disposed approximately at angles within the range of 0° to 15° with horizontal axis.

Figure 9:
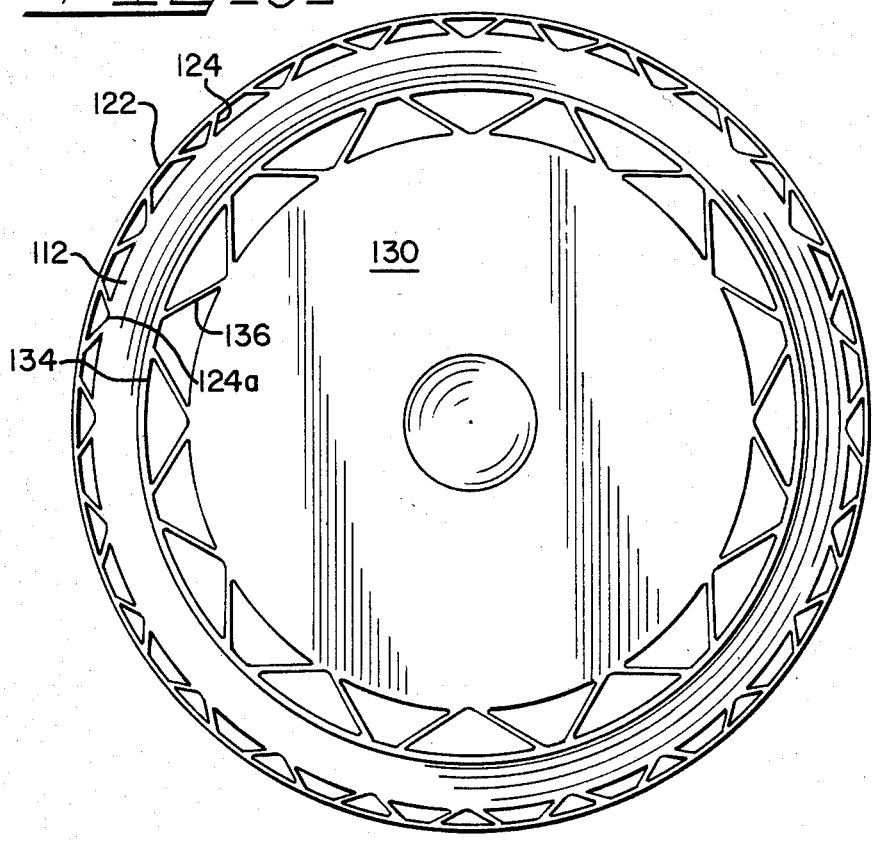
FIG. 9 is an enlarged bottom view of the one of the buckets of FIG. 3 showing diagonal strengthening ribs.
Figure 10:
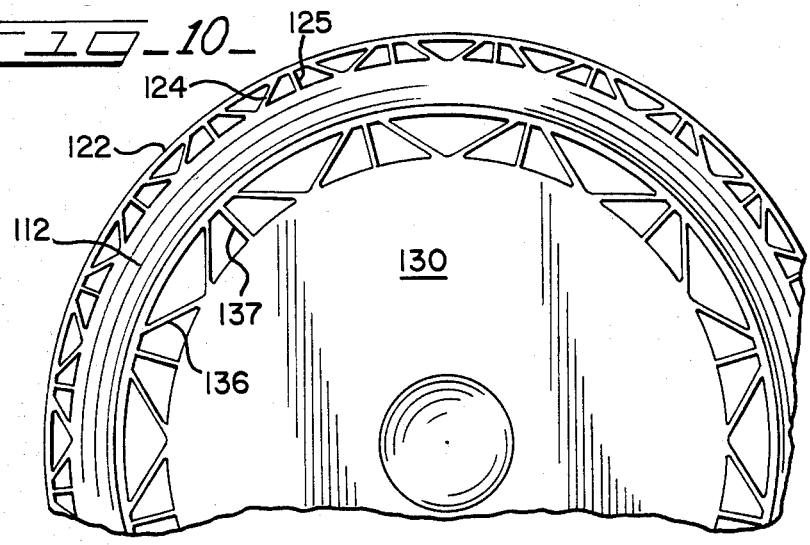
FIG. 10 is a partial bottom view of an alternative embodiment of one of the buckets of FIG. 3 showing a combination of diagonal and radial strengthening ribs.

The projecting annular wall 110 is, in part, supported by a strengthening, curved flange section 122 which is in longitudinal relationship to the wall 112 of the bucket. A plurality of integral strengthening ribs 124 are arranged circumferentially around the mouth of the bucket 100 within flange section 122 between the sidewall of the bucket and the flange section 122 and either are a plurality of diagonal ribs 124 as best shown in FIG. 9 or as shown at 124 and 125 in FIG. 10. The ribs 124 are disposed in a V-shaped arrangement having a modified apex at the ends of each rib 124 being spaced by a section 124*a*. The diagonal ribs 124 combine hoop strength and radial strength with flexibility without cracking. Alternatively, the ribs may include a series of radial ribs 125 for strengthening purposes in a radial direction as shown in FIG. 10.

The bottom 130 of the bucket 100 merges with sloped sidewall 112 through an interface 132 having a large inside radius to increase the strength of the bottom corner of the bucket as compared to prior art molding techniques where high corner stress points are encountered at sharp corners. The plastic is allowed to flow freely around the corner in the molding process of bucket 100 and also into the annular bottom portion or foot 134 in order to prevent corner stress at areas upon which the bucket rests. Diagonally oriented ribs 136, similar to the ribs 124, extend between interface 132 and foot 134 for enhanced strength against toeing in, impact and weight as shown in FIG. 9. As seen in FIG. 10, the ribs 136 may also include radial ribs 137.

Figure 5:
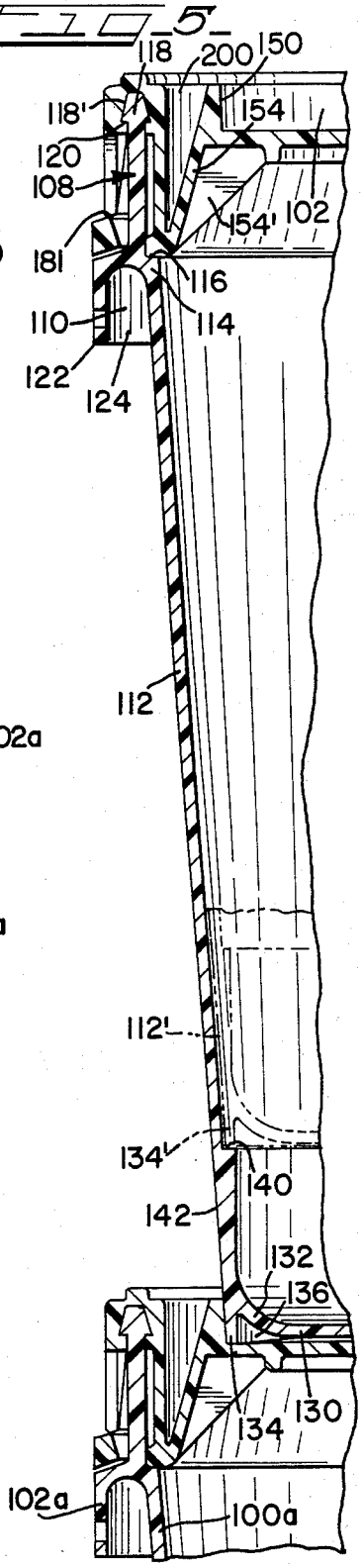
FIG. 5 is an enlarged fragmentary sectional view taken along line 5—5 of FIG. 3.

The wall thickness of the bucket at its lower end may be increased up to 20% by the improved design of the invention to prevent elephant legging under maximum loading to which the bucket is subjected. As shown in FIG. 5, a portion of the bucket is cored out to form an upwardly disposed shoulder 140 on which the foot 134' of a stacked bucket may rest. This allows for buckets having their lids removed to be stacked for an increased height up to the height possible with metal buckets, since the shoulder design and thickened wall 142 beneath the stack provides for suitable strength under loading. As seen in FIG. 5, the outer sidewall 112' of a stacked container is spaced from the inner sidewall of the lower bucket 100 so as not to damage any label or paint which is applied to the container.

Figure 6:
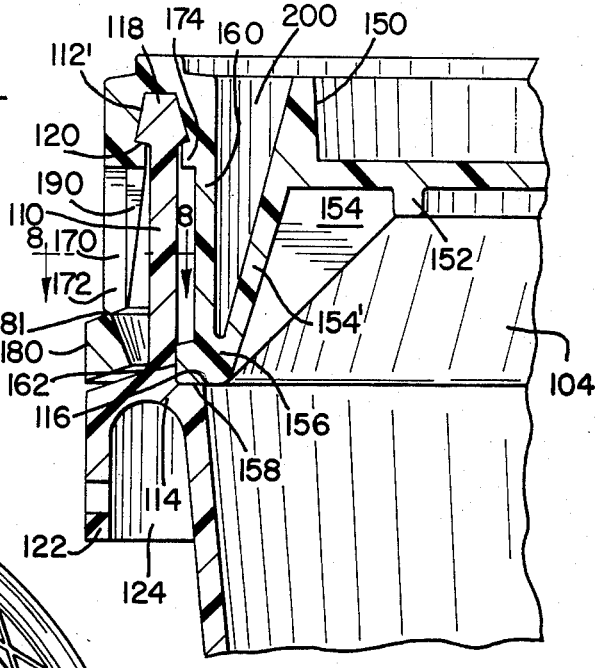
FIG. 6 is an enlarged fragmentary sectional view of the lid and top of the bucket of FIG. 5.
Figure 7:
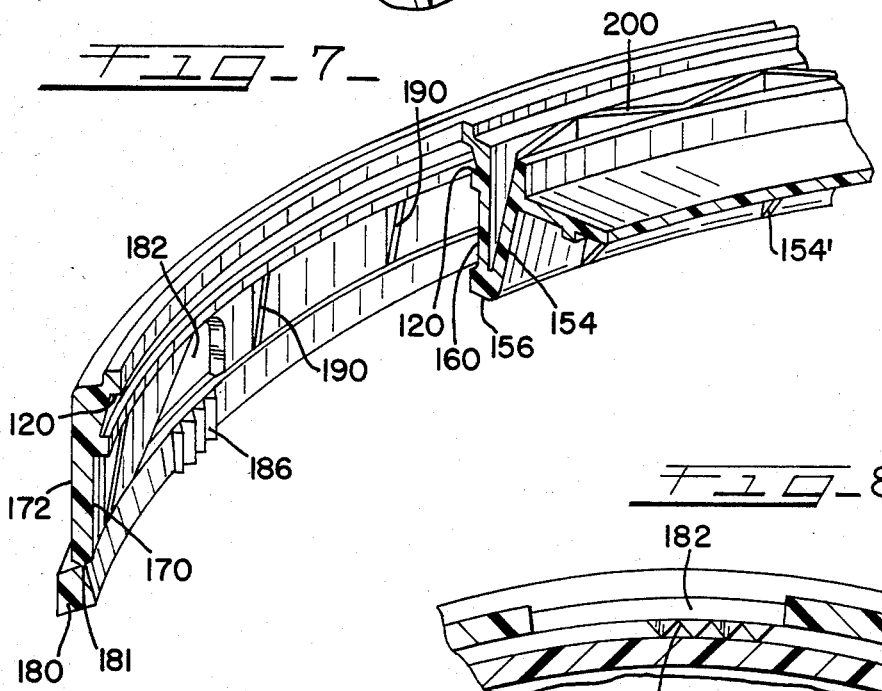
FIG. 7 is a fragmentary perspective view, with parts in section of the outer, portion of the cover of the invention.
Figure 8:
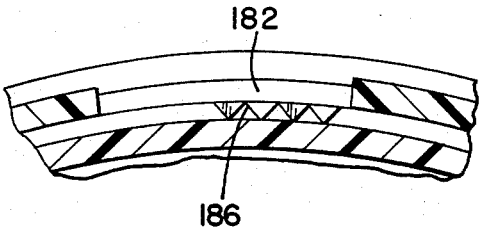
FIG. 8 in a fragmentary sectional view taken along line 8—8 of FIG. 6.

Referring now to FIGS. 6, 7 and 8, the improved lid 102 is best illustrated. A central portion of the lid has been modified as compared to the lid shown in FIG. 2 of the preceding embodiment. An upright, annular straight wall 150 is formed on the top of the lid to surround the foot area 134 of a bucket stacked thereon. The lid 102 includes a bottom, annular rib 152 to strengthen its structure. A sloped annular wall 154 is formed by a straight portion of the lid which extends downward in a vertical direction and outward to interconnect with a base section 156. The lid wall 154 and the stack supporting areas next to it include a series of radial ribs 154', or other orientation when appropriate, (FIG. 5) to strengthen the lid and to support the weight of containers thereon. The base section 156 has an annular bottom surface 158 to contact the ledge 116 formed in the bucket.

The base section 156 protrudes outward beyond a vertical annular wall 160 and includes an outer rim 162 to bear against a portion of projection 110. The base 156 has an enlarged cross section for greater strength and to aid in support of both the sloped wall 154 and the upward vertical wall 160. The lid is formed with a bent back outer skirt portion 170 which together with wall 160 defines a recess 112 having a pair of lips 174 to engage stop shoulders 120 of the projection 110. The sloped shape 112 of the side of projection 112 separates the lips 174 to allow the lid recess to snap into place for firm retention of the lid, even under impact conditions.

The skirt 170 has generally constant thickness wall 172 terminating with a continuous strip 180 which continuously extends around the bottom edge of the outer skirt 170. The integral strip 180 is interconnected with the bottom of the outer skirt 170 by a generally circumferential area 181 of reduced thickness to enable the strip 180 to be torn or separated from the skirt 170 after it is cut at break area at window 182, as best shown in FIG. 7. Window 182 provides an opening into which a tool may be inserted and the strip 180 cut or severed to allow it to be pulled away from the skirt 170 and permit removal of the lid 102. A series of serrations 186 are provided on strip 180 beneath the window 182 to facilitate removal of the tear strip by providing a friction enhanced, gripping surface. Any tool, such as a screwdriver and the like, may be used initially to sever or cut the tear strip so that the strip cannot be arbitrarily removed prior to actual usage or opening of the loaded buckets from pushing the lid and bucket. To strengthen the lid and bucket top upward, a plurality of triangular ribs 190 are formed in the internal skirt wall 172 as best shown in FIG. 7.

Figure 4:
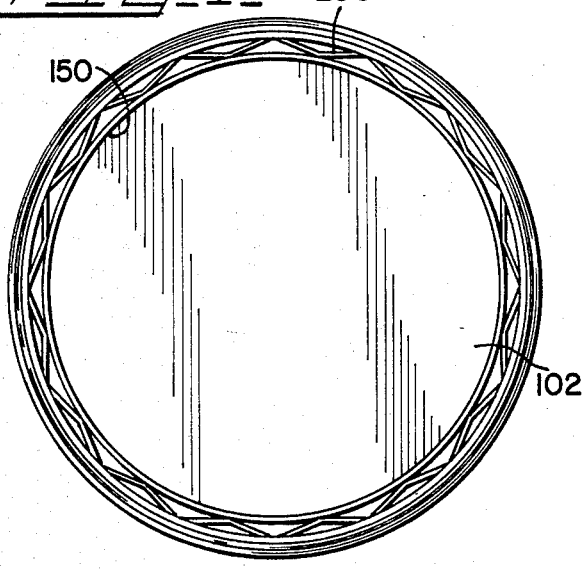
FIG. 4 is a top plan view of the second embodiment of FIG. 3.
Figure 4A:
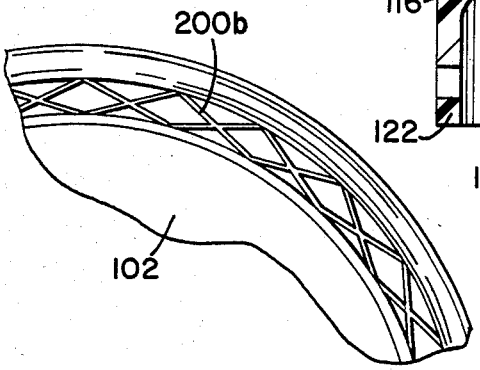
FIG. 4*a* is an enlarged fragmentary top plan view of an alternative arrangement of ribs of the second embodiment of FIG. 3.

Strengthening ribs 200 are disposed between wall 154 and wall 160 of the lid circumferentially around the container and are diagonally oriented (FIGS. 4 and 7) in the manner of ribs 124 and 136 as seen in FIG. 9 or with radial ribs for additional strength in FIG. 10. Ribs 200 are radially disposed while ribs 200 are diagonally oriented as shown in FIG. 4 for maximum strength. Alternative rib criss-crossing formations for ribs **200*b* as shown in FIG. 4*a*** may also be employed for maximum hoop strength as an additional alternative embodiment.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A lid for removable attachment to a molded bucket comprising:

said lid defining a peripheral, annular recess adapted to receive the annular projection of a bucket in locking relationship;

said annular recess being formed by an internal annular portion and an external skirt portion lying in radial spaced relation thereto, said recess and skirt portion being joined by an intermediate portion defining said recess;

said skirt portion having a lower detachable strip extending generally continuously about the bottom edge of said skirt portion to retain said lid against removal of said skirt portion; and said detachable strip being removable by being physically severed at a break area, said strip being capable of being manually detached from said skirt upon being severed for removal of said lid;

wherein said lid includes a pair of spaced, approximately annular walls, and a plurality of strengthening ribs disposed between said walls, said ribs being disposed diagonally to form side-by-side V-shaped formations.

2. The lid of claim 1 wherein said skirt portion includes a window adjacent said break area, said window provides access to said strip by a tool for severing said strip.

3. The lid according to claim 2 wherein said strip includes a friction enhanced portion adjacent said break area.

4. The lid according to claim 1 further including radial ribs.

5. A molded bucket comprising:

a tapered sidewall defining the sides of the bucket and forming an open mouth having an annular projection at said mouth;

an integral bottom coupled to said sidewall at a transitional area;

said transitional area being molded with a relatively large radius and having a thickness approximately equal to the thickness of said bottom;

said radius and thickness preventing stress concentration from weakening the bucket;

wherein said transitional area curves upward longitudinally to said sidewall, an annular sidewall continuously extending around said bottom in alignment with said sidewall, said annular wall having a bottom edge forming a lower support surface projecting beyond the bottom surface of said bucket; and a plurality of ribs arranged around the bucket and extending between said annular wall and the radial outer portion of said bottom.

6. The molded bucket according to claim 5 wherein said ribs are arranged in diagonal orientations forming side-by-side generally V-shaped ribs.

7. The molded bucket according to claim 5 further including radial ribs.

8. A lid for removable attachment to a molded bucket comprising:

said lid defining a peripheral annular recess adapted to receive the annular lip of a bucket in locking relationship;

said annular recess being formed by an internal annular portion and an external skirt portion lying in radial, spaced relation thereto, said recess and skirt portion being joined by an intermediate portion defining said recess, said lid also defining an inner annular wall within said internal annular portion, with a plurality of strengthening ribs exposed between said internal annular portion and inner annular wall, said ribs being disposed therebetween diagonally to form side-by-side V-shaped formations.

9. The lid according to claim 8 further including radial ribs positioned inside of said inner annular wall.

* * * * *